US005210966A

United States Patent [19]

Fuehrer

[11] Patent Number: 5,210,966

[45] Date of Patent: May 18, 1993

[54] INDENTIFICATION TAG

[75] Inventor: Charles Fuehrer, Scarsdale, N.Y.

[73] Assignee: Stoffel Seals Corporation, Tuckahoe, N.Y.

[21] Appl. No.: 778,654

[22] Filed: Oct. 18, 1991

[51] Int. Cl.[5] ..... A44C 3/00

[52] U.S. Cl. ..... 40/1.5; 24/707.6

[58] Field of Search ..... 40/1.5, 1.6, 652, 666, 40/667; 63/18, 19, 20; 24/6, 12, 13, 707.3, 707.6

[56] References Cited

U.S. PATENT DOCUMENTS

| | | | |
|---|---|---|---|
| 1,626,133 | 4/1927 | Day . | |
| 1,765,325 | 6/1930 | Day . | |
| 1,785,186 | 12/1930 | Day . | |
| 1,867,964 | 7/1932 | Bott . | |
| 2,050,804 | 8/1936 | Philippe | 63/20 |
| 2,113,786 | 4/1938 | Garfinkel | 63/20 |
| 2,145,296 | 1/1939 | Draper et al. . | |
| 2,232,060 | 2/1941 | Foster | 40/1.5 |
| 2,341,467 | 2/1944 | Nedell | 40/1.5 |
| 2,357,231 | 8/1944 | Sleeper | 40/1.5 |
| 3,559,318 | 2/1971 | Sitzberger | 40/1.5 |
| 3,810,321 | 5/1974 | Kiba | 63/20 |
| 3,953,910 | 5/1976 | Farb | 24/13 |
| 4,020,575 | 5/1977 | Kruger et al. | 40/1.5 |
| 4,597,206 | 7/1986 | Benson | 40/1.5 |
| 4,869,004 | 9/1989 | Maloney | 40/1.5 |

FOREIGN PATENT DOCUMENTS

| | | | |
|---|---|---|---|
| 1517055 | 3/1968 | France | 40/1.5 |
| 1558318 | 2/1969 | France | 24/13 |
| 2475867 | 8/1981 | France | 40/1.6 |
| 2212779 | 8/1989 | United Kingdom | 40/1.5 |

*Primary Examiner*—Kenneth J. Dorner
*Assistant Examiner*—Milton Nelson, Jr.
*Attorney, Agent, or Firm*—Dowell & Dowell

[57] ABSTRACT

An identification tag which includes a channel for receiving the base of a crimp pin assembly and wherein the channel is defined by opposing flanges having a slot therebetween through which portions of the pin assembly extend and wherein protrusions are provided adjacent the flanges for preventing the removal of the pin assembly once it is seated within the channel.

9 Claims, 1 Drawing Sheet

INDENTIFICATION TAG

BACKGROUND OF THE INVENTION

1. Field of the Invention

This invention is generally related to identification tags and badges of a type which are designed to be worn on an individual's clothing by securing the tag or badge using a lockable crimp pin or safety pin which is attached to the body of the tag. More specifically, the invention is directed to tags and badges which are formed of a molded plastic material and which include an integrally molded channel along the rear surface thereof in which the base of a crimp pin is slidably received to thereby securely lock the pin to the tag or badge.

2. History of the Related Art

Most conventional tags, badges, buttons or the like, are attached to an area of an article of clothing or wearing apparel such as a pocket or lapel by using safety or double lock crimp pins which are mounted to such items. The pins are designed to extend through a portion of cloth with the tip of the pin thereafter being retained from withdrawal or displacement by a U-shaped catch formed either integrally with the pin or extending from the body of the tag or badge. Unfortunately, most pins are mounted to tags and badges in such a manner that the pins are easily separated therefrom thereby destroying the usefulness of the tags and badges for future use.

U.S. Pat. No. 1,626,133 to Day discloses a badge having a cellulose body which is bent to provide front and rear panels having spaced openings therein through which portions of a safety or double lock crimp pin extend. There is nothing within the structure to retain the pin rigidly with respect to the cellulose material and therefore the pin may pivot relative to the material and may be easily displaced by pulling the pin relative to the body of the badge. Another type of badge or button design for attaching to wearing apparel is disclosed in U.S. Pat. No. 1,765,325, also to Day. In this patent a license or other object is designed to be mounted between a front portion and rear removable portion of a badge. A safety pin member may be positioned between the front and rear portions and is retained by frictionally engaging the rear portion of the badge within an annular flange which extends along the periphery of the front portion of the badge. The pin may be removed by frictionally disengaging the rear portion from the front portion and thus the pin can accidently be misplaced if the portions are accidently separated. Modifications of the button or badge are disclosed in U.S. Pat. Nos. 1,785,186, also to Day and United States patent 1,867,964 to Bott.

A different type of badge is disclosed in U.S. Pat. No. 214,296 to Draper et al. In Draper, the front of the badge has rearwardly extending flanges which slidingly receive a rear or back plate having a slot and an opening therein with the pin assembly being carried by the back plate. As with other prior art identification tags and badges, if the back plate is slidingly moved with respect to the front plate the pin assembly may be easily disengaged and accidently misplaced. A somewhat similar arrangement is shown in U.S. Pat. No. 2,357,231 to Sleeper, wherein the rear of the badge is slidingly received within the front portion of the badge and wherein the pin assembly is mounted through openings in the rear portion of the badge.

Another means of mounting a pin assembly to a badge is disclosed in U.S. Pat. No. 4,869,004 to Maloney. In this patent, the base portion of the pin assembly is adhesively secured to the back portion of the badge. Unfortunately, such adhesive arrangements do not adequately secure the pin assembly relative to the badge and the pin assembly can be easily removed from the badge.

Further examples of identification badges or display buttons and the like are disclosed in U.S. Pat. Nos. 2,232,060 to Foster; 3,559,318 to Sitzberger; and 4,021,575 to Kruger et al.

SUMMARY OF THE INVENTION

An identification tag, badge and/or advertising or display button which includes a molded body having a front display surface and a rear surface and wherein a channel is integrally molded along the rear surface to thereby provide a support for receiving and positively retaining the base of a double lock crimp pin. The channel includes a pair of inverted L-shaped flanges which define a slot therebetween which is closed at one end but open at the other. The pin assembly is a conventional double lock crimp pin which includes a serpentined base which is integrally connected at one end to an elongated shaft by a coiled spring oriented perpendicularly with respect to the base. The opposite end of the base includes a hook which designed to retain the elongated pin shaft against the force of the coiled spring. The width of the channel is essentially equal to the width of the base of the pin assembly and the depth of the channel is substantially equal to the height of the base of the pin assembly so that pin assembly will be securely and frictionally retained within the channel when inserted therein. The slot within the channel is generally of a width equal to the width of the hooked end of the pin assembly so as to engage and stabilize the hooked end on either side thereof that extends through the slot. An enlarged notch is provided adjacent the open end of the channel for securing the coiled spring portion of the pin assembly therein and is of a size to engage the opposite sides of the coiled end to further stabilize the pin assembly with respect to the body of the badge.

To prohibit the pin assembly from being removed from the channel after being inserted therein the opening thereto is slightly narrower than the coiled end of the pin assembly. Also, the opening is tapered inwardly toward the notch so that the coiled end of the pin assembly is automatically forced or urged into the notch as the pin assembly is inserted therein. To further stabilize the pin assembly a pair of opposing flanges taper upwardly from adjacent the either side of the opening and will engage the pin assembly therebetween.

It is a primary object of the present invention to provide an identification tag or badge having a display body formed as a molded unit and which incorporates an integrally formed channel along the rear surface thereof for positively stabilizing and securing a conventional pin assembly in such a manner that the pin assembly cannot be accidently removed from the badge and wherein the proper orientation of the badge relative to the pin assembly is continuously assured.

It is also an object of the present invention to provide an identification tag or badge wherein the pin assembly for securing the badge to an article of clothing is assembled to the body of the tag without the use of adhesives or separate mechanical fasteners.

An additional object of the present invention is to provide an identification tag or badge wherein the display or body portion of the badge may be assembled to the fastening pin assemblies after manufacture and thus may be separately packaged and shipped as is necessary.

DESCRIPTION OF THE PREFERRED EMBODIMENT

Figure 1:
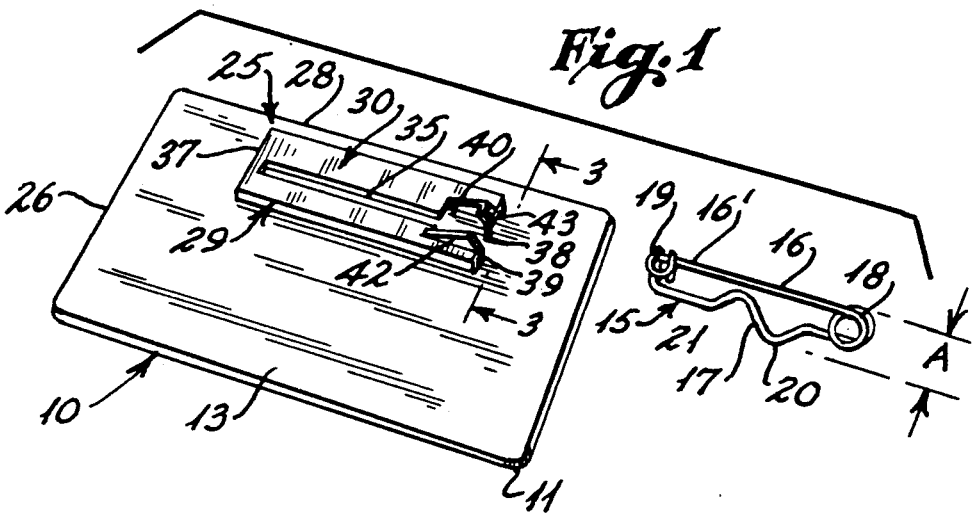
FIG. 1 is a rear perspective assembly view of the badge or identification tag of the present invention showing the locking channel integrally formed on the rear surface of the body of the badge and showing the double lock crimp pin in spaced relationship with respect thereto.
Figure 2:
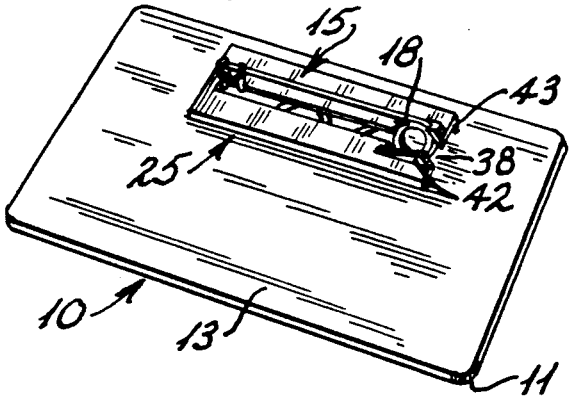
FIG. 2 is a rear perspective view showing the pin assembly of FIG. 1 retained within the locking channel of the body portion of the identification tag.
Figure 3:
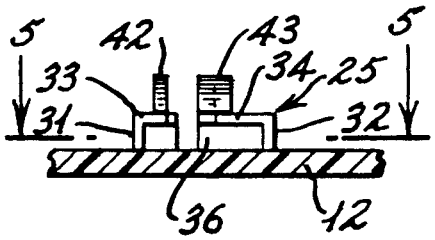
FIG. 3 is an enlarged view taken along line 3—3 of FIG. 1.

With continued reference to the drawings, the identification tag or badge 10 of the invention includes a generally planar body portion 11 having a front surface 12 and rear surface 13. The body portion is formed of a molded plastic material and the front surface may have a variety of advertising or identification indicia (not shown) applied thereto either by printing, coating, or separate adhesive label or strip.

The body portion of the tag is constructed so as to be selectively assembled with a pin assembly 15 which is a conventional double lock crimp pin type. The pin assembly includes an elongated straight pin element 16 which is integrally connected to a serpentine base portion 17 by way of an intermediate coil spring 18. A hook portion 19 extends outwardly with respect to the base 17 adjacent the end opposite the coil spring 18 and serves to selectively retain the outer end portion 16' of the straight pin element 16 after the pin element has been inserted through a supporting material. As shown, the base portion of the pin assembly includes outer projecting portions 20 and 21 which serve as stabilizing elements for the pin assembly as will be discussed in greater detail hereinafter.

To rigidly and non-removably mount the pin assembly 15 to the rear surface 13 of the identification tag or badge 10, a locking channel 25 is integrally molded generally centrally of the sides 26 and 27 of the badge and adjacent the upper edge 28 thereof. It should be noted that the locking channel may be molded at any point along the rear surface of the badge, such as extending between the upper and lower edges if a different orientation of the badge is desired. The locking channel 25 includes a pair of generally inverted L-shaped members 29 and 30 having leg portions 31 and 32 extending outwardly with respect to the rear surface 13 of the badge and inwardly extending flanges 33 and 34 which are spaced relative to one another so as to define an elongated slot 35 therebetween.

With reference to FIG. 1, the outer ends of the projecting portions 20 and 21 of the base of the pin assembly are spaced a distance dimension "A" from one another. The spacing between the leg portions 31 and 32 of the inverted L-shaped flanges 29 and 30 are also generally spaced apart a distance equal to dimension "A" so that when the base of the pin assembly is received within the locking channel the projecting portions 20 and 21 will actually be engaged with the leg portions 31 and 32 of the inverted L-shaped channel members. Further, the material from which the pin assembly is made is a wire material having a thickness "T". The height of the space 36 formed between the inverted L-shaped channels and the rear surface 13 of the badge is equal to dimension T in such a manner that when the base of the pin assembly is mounted within the channel the base will be securely frictionally retained and prevented from rotating relative to the rear surface 13 of the badge. In this manner, when the badge is pinned to an article of clothing the pin assembly cannot be rotated relative to the badge and therefore the badge will maintain its properly oriented position relative to the article of clothing to which the badge has been mounted.

Figure 4:
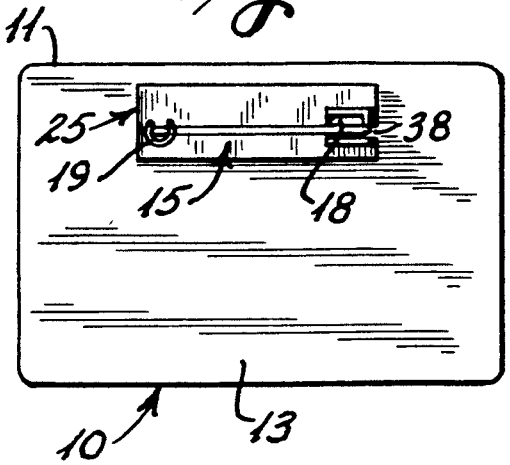
FIG. 4 is a rear elevational view of the identification tag of FIG. 2.
Figure 5:
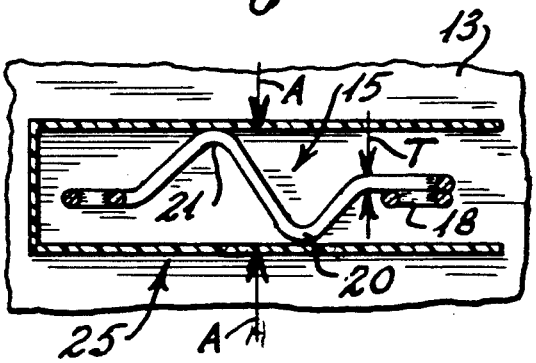
FIG. 5 is an enlarged partial rear elevational view having portions broken away showing the base portion of a pin assembly seated within the locking channel of the present invention.

The slot 35 is closed at one end 37 of the locking channel but includes an inverted T-shaped opening 38 adjacent the opposite end 39 thereof. The opening 38 is spaced from the remaining portion of the slot 35 by an enlarged notch 40 which is generally of a dimension to receive the coil spring end 18 of the pin assembly, as is shown in FIGS. 4 and 5. Further, the notch 40 is shown as being offset relative to the elongated axis of the slot 35 and the upper portion of the opening 38. The upper portion of the opening 38 is of a width which is less than the thickness dimension of the coiled end 18 of the pin assembly 15 however the edge portions defining the opening are slightly yieldable to allow the forced passage of the coiled end of the spring assembly therebetween. The opening, is also wide enough at its base portion to allow the passage of the projecting portions 20 and 21 of the pin assembly 15 so that the channel space 36 is generally continuous in dimension from the open end 38 to the closed end. When the base 17 of the pin assembly 15 is slidingly urged so that the hook portion 19 passes through the opening and into the slot 35, continued movement of the pin assembly will cause the coiled end 18 thereof to frictionally pass through the upper portion of the opening after which the coiled end will snap into the notch 40. Therefore, after the coiled end 18 of the pin assembly enters the notch 40 removal of the pin assembly is prevented.

To further stabilize the pin assembly with respect to the locking channel and to facilitate the insertion of the pin assembly within the channel outwardly extending flange portions or protrusions 42 and 43 are provided adjacent the notch 40 to engage the extended portions of the coiled end 18 to thereby further prevent relative rotation or pivoting of the pin assembly with respect to the locking channel. The flange portions are tapered upwardly and inwardly from the opening 38.

From the foregoing, the pin assembly is securely seated and retained in non-movable relationship with respect to the body portion 11 of the badge by the locking channel 25. The pin assembly also cannot be removed from the locking channel without physically destroying the edge portions defining the opening 38 into the slot 35 of the channel.

As the conventional double lock crimp pins utilized with the present invention may be separately obtained, such assemblies may be easily installed and locked within the identification tags of the present invention just prior to the use of the badges or tags. In this regard, the body portion of the badges or tags, together with the integral locking channels may be formed or manufactured at one location and assembly by an end user the end user obtaining conventional double lock crimp pins which may be inserted within the locking channel of the body portions of the badges at any time prior to the use of the badges.

I claim:

1. An identification tag for use with a crimp pin assembly, wherein the crimp pin assembly includes a base connected to a straight pin by way of a coiled spring and which also includes a hooked end extending outwardly of the base opposite the coiled spring, the tag comprising, a body having front and rear surfaces, a channel defined along said rear surface of said body by a pair of spaced flanges, said flanges having first and second ends and intermediate portions which extend generally parallel to said rear surface of said body, said intermediate portions of said flanges having opposing edges defining a slot therebetween which communicates with said channel, said channel being substantially wider than said slot, an opening into said channel at said first ends of said flanges of a size to permit the base of the pin assembly to be slidingly received within said channel with the hooked end thereof extending outwardly through said slot, a notch formed in one of said flanges, said notch communicating with said slot at a point spaced from said first end of said flanges, said notch being offset with respect to an axis taken along said slot and being of a size to permit the coiled spring of the crimp pin assembly to be seated therein, and protrusion members extending outwardly from each of said flanges adjacent said first end thereof for engaging the coiled spring when the coiled spring is seated within said notch and which thereby prevent the crimp pin assembly from being removed from the tag.

2. The identification tag of claim 1 in which said second ends of said flanges are joined to one another thereby closing said slot.

3. The identification tag of claim 1 in which said flanges are integrally molded with said body.

4. The identification tag of claim 3 in which the base of the crimp pin assembly has a first width dimension, said channel being of a width dimension substantially equal to said first width dimension.

5. The identification tag of claim 4 in which the hooked end of the crimp pin assembly engages and is stabilized by said flanges when the crimp pin assembly is inserted within said channel.

6. The identification tag of claim 1 in which the base of the crimp pin assembly has a first width dimension, said channel being of a width dimension substantially equal to said first width dimension.

7. The identification tag of claim 6 in which the hooked end of the crimp pin assembly engages and is stabilized by said flanges when the crimp pin assembly is inserted within said channel.

8. The identification tag of claim 7 in which said protrusion members taper from said first end inwardly and upwardly toward said second end of said flanges.

9. The identification tag of claim 8 in which said flanges are integrally molded with said body.

* * * * *